United States Patent [19]

Sherard

[11] Patent Number: 5,006,105

[45] Date of Patent: Apr. 9, 1991

[54] NEWBORN INFANT THERAPY APPARATUS

[76] Inventor: Timothy L. Sherard, 307 S. Hite Ave., Louisville, Ky. 40218

[21] Appl. No.: 568,906

[22] Filed: Aug. 17, 1990

[51] Int. Cl.[5] ..... A61G 11/00

[52] U.S. Cl. ..... 600/22

[58] Field of Search ..... 600/21, 22; 128/205.26, 128/202.12, 877, 362, 371, 373, 374, 375, 395, 396

[56] References Cited

U.S. PATENT DOCUMENTS 4,321,913 3/1982 Maluta ..... 600/22
4,809,677 3/1989 Mackin ..... 600/22

OTHER PUBLICATIONS

Infa-Care 2000 Brochure Published by Infa-Care Inc. 1348 Baur Blvd., St. Louis, Miss. 63132.

*Primary Examiner*—Kyle L. Howell
*Assistant Examiner*—Robert L. Nasser, Jr.
*Attorney, Agent, or Firm*—Leon Gilden

[57] ABSTRACT

An apparatus setting forth a therapy apparatus for newborn infants, including a cabinet member mounting life monitoring equipment and storage compartments therewithin, including a planar top surface mounting a chamber, with the chamber including transparent side panels and an extensible and contractable cover housing to permit ease of access to the infant, with the housing including slot members hingedly mounted together and securable within opposed lateral tracks, with the tracks further including photo-therapy illumination members extending longitudinally of the slats, and further including a support cushion positionable upon a floor of the cavity.

7 Claims, 4 Drawing Sheets

PRIOR ART

NEWBORN INFANT THERAPY APPARATUS

BACKGROUND OF THE INVENTION

1. Field of the Invention

The field of invention relates to life support apparatus, and more partiularly pertains to a new and improved newborn infant therapy apparatus wherein the same accommodates a therapy system to sustain a newborn infant.

2. Description of the Prior Art

Infant incubators and radiation structure is available in the prior art to accommodate premature and newly born infants. Conventional incubators are available, as well as incubators with radiation devices, that are resorted to accommodate inherent physical problems associated with this classification of infants. The instant invention attempts to overcome deficiencies of the prior art by providing an organization accommodating a newborn infant with an array of support and monitoring structure. Examples of the prior art include U.S. Pat. No. 4,750,474 to Dukhan, et al. setting forth an incubator organization providing artificial illumination in association with a heating organization.

U.S. Pat. No. 4,509,505 to Mercey, et al. sets forth an isolator organization to isolate an individual in a sterile environment and maintaining desired temperatures therewithin.

U.S. Pat. No. 4,328,793 to Martin sets forth an incubator including a bacterial filter and humidifier.

U.S. Pat. No. 4,881,938 to Lindley sets forth a resuscitator, respirator, and/or incubator organization to include oxygen admitting structure within a chamber, wherein the chamber is divided by partitions into separate gas-tight head and body compartments.

U.S. Pat. No. 4,681,090 to Koch provides an incubator structure for premature and newborn infants combining a structure to include an enclosure that communicates with air within the compartment of the incubator to permit thermal disinfecting of such air.

As such, it may be appreciated that there continues to be a need for a new and improved newborn infant therapy apparatus wherein the same addresses both the problems of ease of use as well as effectiveness in construction in accommodating a system for maintaining and monitoring life support for a newborn infant and in this respect, the present invention substantially fulfills this need.

SUMMARY OF THE INVENTION

In view of the foregoing disadvantages inherent in the known types of newborn infant apparatus now present in the prior art, the present invention provides a newborn infant therapy apparatus wherein the same includes a system for monitoring and accommodating premature and newborn infants. As such, the general purpose of the present invention, which will be described subsequently in greater detail, is to provide a new and improved newborn infant therapy apparatus which has all the advantages of the prior art newborn infant apparatus and none of the disadvantages.

To attain this, the present invention provides an apparatus setting forth a therapy apparatus for newborn infants, including a cabinet member mounting life monitoring equipment and storage compartments therewithin, including a planar top surface mounting a chamber, with the chamber including transparent side panels and an extensible and contractable cover housing to permit ease of access to the infant, with the housing including slot members hingedly mounted together and securable within opposed lateral tracks, with the tracks further including photo-therapy illumination members extending longitudinally of the slats, and further including a support cushion positionable upon a floor of the cavity.

My invention resides not in any one of these features per se, but rather in the particular combination of all of them herein disclosed and claimed and it is distinguished from the prior art in this partcular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved newborn infant therapy apparatus which has all the advantages of the prior art newborn infant apparatus and none of the disadvantages.

It is another object of the present invention to provide a new and improved newborn infant therapy apparatus which may be easily and efficiently manufactured and marketed.

It is a further object of the present invention to provide a new and improved newborn infant therapy apparatus which is of a durable and reliable construction.

An even further object of the present invention is to provide a new and improved newborn infant therapy apparatus which is susceptible of a low cost of manufacture with regard to both materials and labor, and which accordingly is then susceptible of low prices of sale to the consuming public, thereby making such newborn infant therapy apparatus economically available to the buying public.

Still yet another object of the present invention is to provide a new and improved newborn infant therapy apparatus which provides in the apparatuses and methods of the prior art some of the advantages thereof, while simultaneously overcoming some of the disadvantages normally asssociated therewith.

Still another object of the present invention is to provide a new and improved newborn infant therapy apparatus wherein the same is arranged to provide life support and monitoring of newborn infants.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
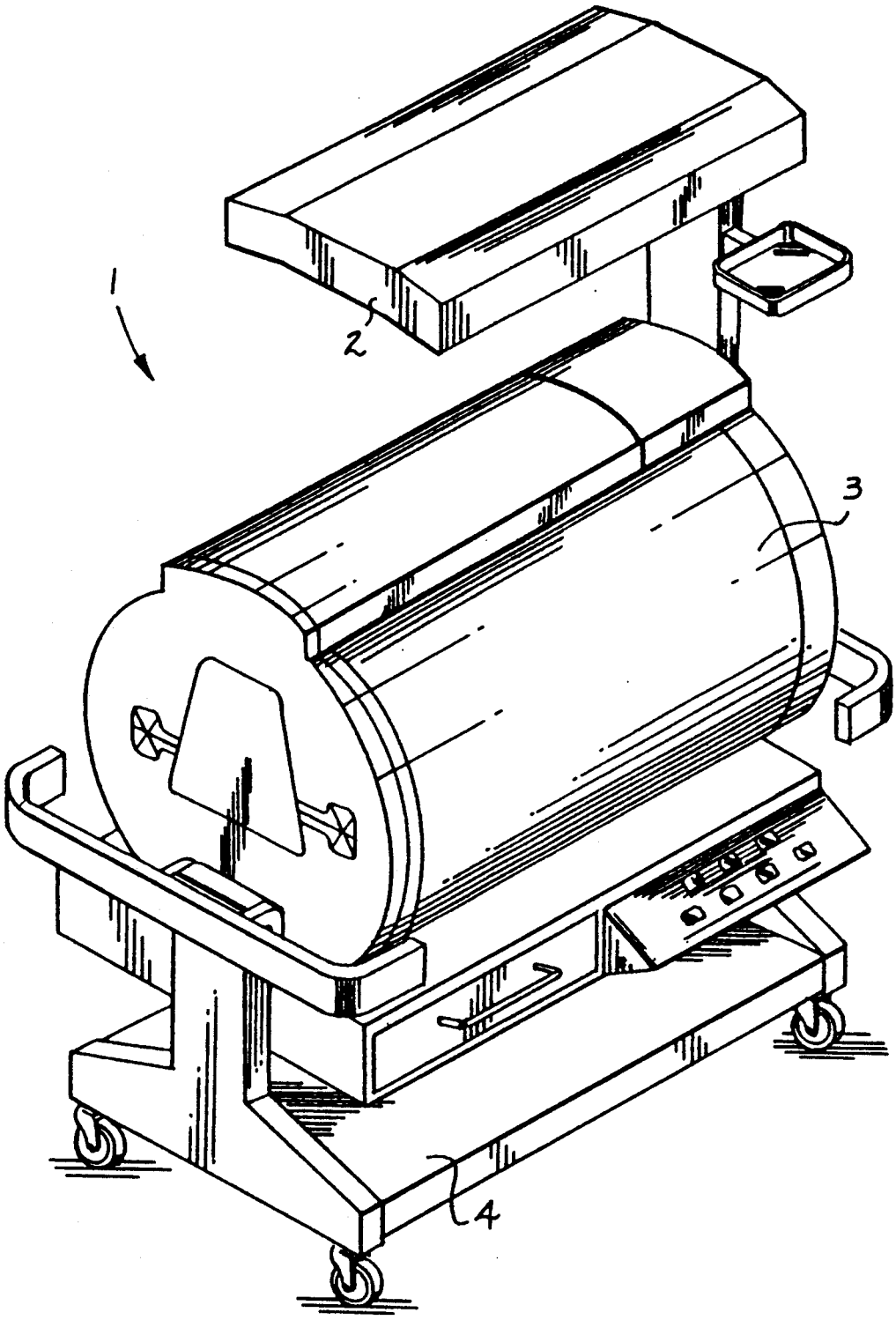
FIG. 1 is an isometric illustration of a prior art infant therapy organization.

With reference now to the drawings, and in particular to FIGS. 1 to 7 thereof, a new and improved newborn infant therapy apparatus embodying the principles and concepts of the present invention and generally designated by the reference numeral 10 will be described.

FIG. 1 illustrates a prior art newborn infant incubator and therapy organization as set forth in U.S. Pat. No. 4,750,474, including an illumination device to overlie a housing 3 that is rotatably mounted on a support platform 4 to provide artificial illumination and IR-Radiation heating.

Figure 2:
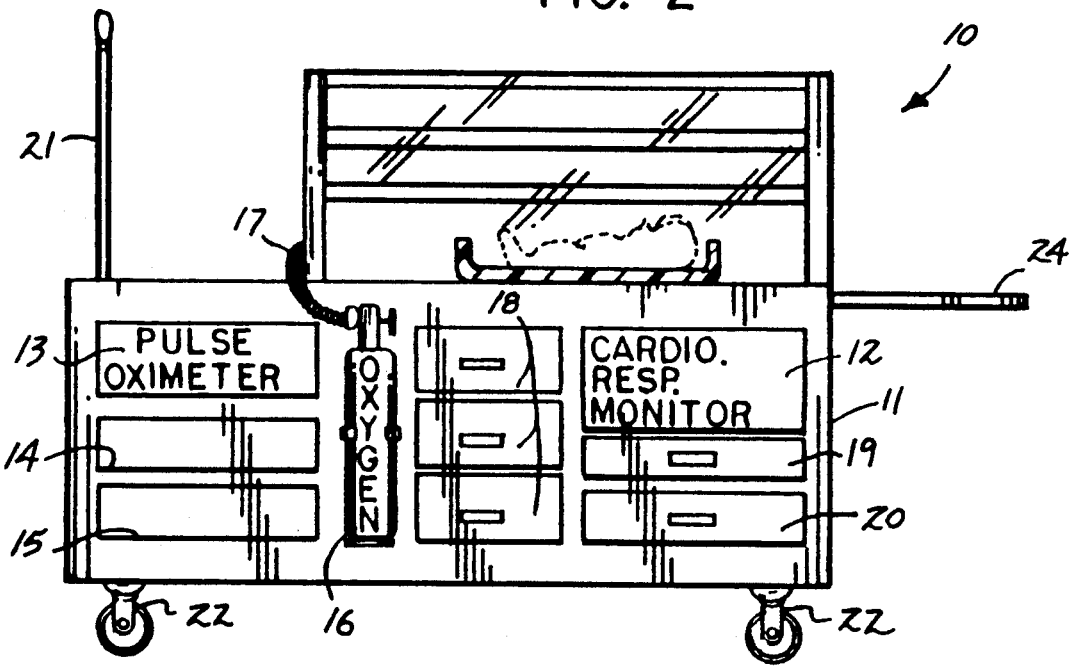
FIG. 2 is an orthographic frontal view, taken in elevation, of the instant invention.
Figure 3:
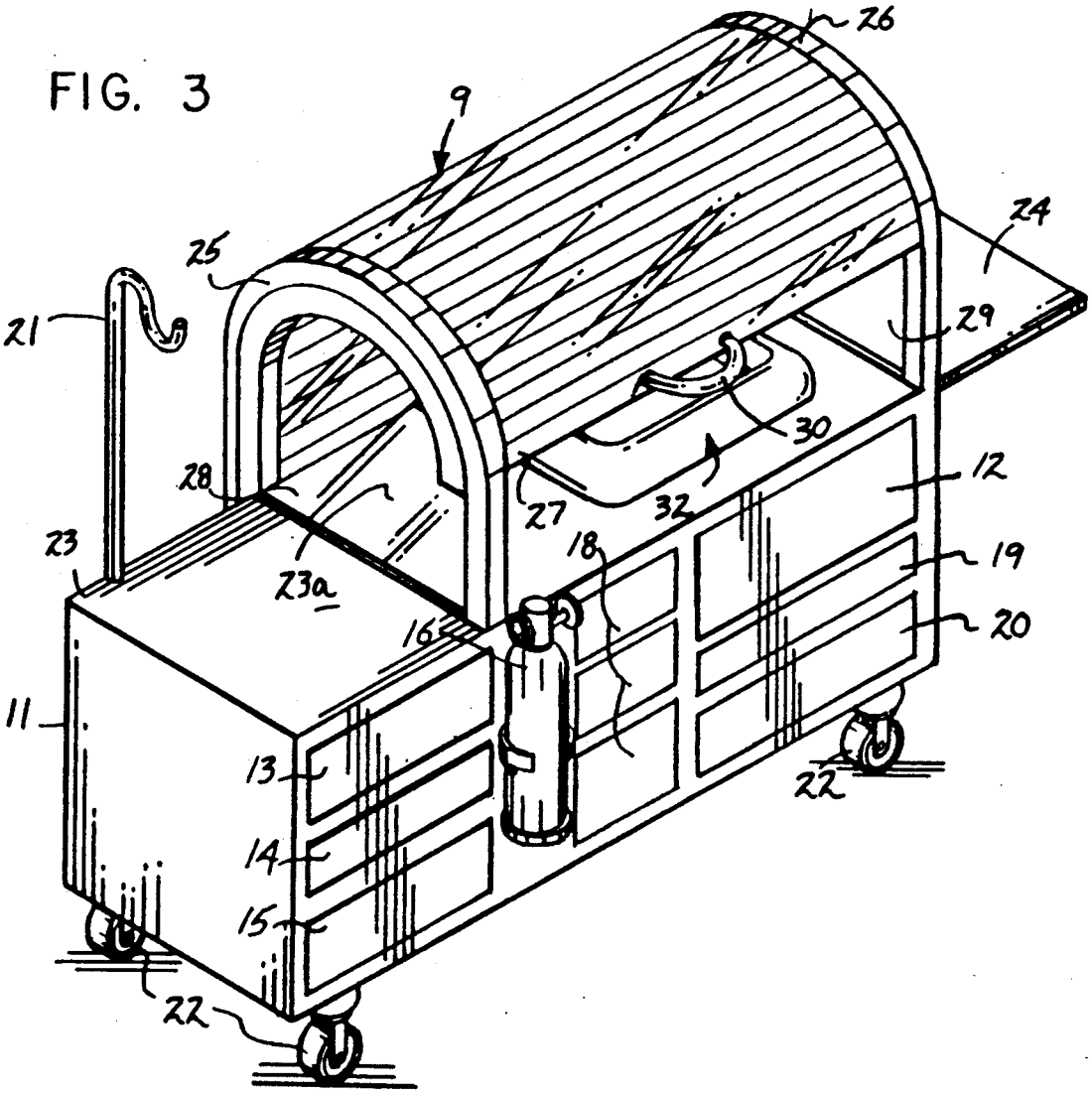
FIG. 3 is an isometric illustration of the instant invention.

More specifically, the newborn infant therapy apparatus 10 of the instant invention essentially comprises a support cabinet housing 11, including a cardio-respirator monitor device 12 mounted therewithin, as well as a pulse-oximeter 13 positioned adjacent an upper surface of the cabinet housing 11 for convenience of access thereto in the monitoring of life support of a newborn infant. A first and second shelf 14 and 15 respectively are mounted underlying the pulse-oximeter 13, with an oxygen tank 16 positioned adjacent thereto, including an oxygen tank supply conduit 17 to direct oxygen within the infant support chamber, as illustrated in FIG. 2. A plurality of aligned supply drawers 18 are positioned in alignment adjacent the oxygen tank 16 for storage of various emergency supplies and the like, with an equipment drawer 19 positioned underlying the cardio-respirator monitor device 12, and an emergency supply drawer 20 positioned underlying the equipment drawer 19. Castor wheels 22 are provided underlying the cabinet housing for ease of transport of the organization. A planar horizontal left support shelf 23 defines an upper surface of the cabinet housing, with an intravenous support post and hook structure 21 positioned adjacent a rear edge of the left support shelf 23. A chamber support floor **23*a* is positioned in alignment with the left support shelf 23, and with a right support shelf 24** that extends longiudinally and beyond the housing, as illustrated, in alignment with the support shelf and planar floor structure.

Figure 4:
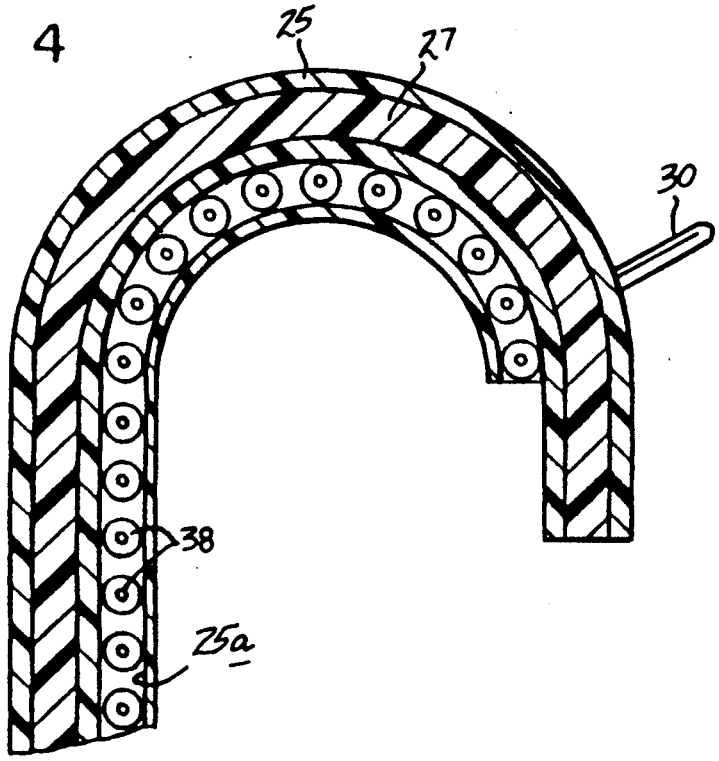
FIG. 4 is a cross-sectional illustration of the support of the photo-therapy tubes in the housing of the instant invention.
Figure 5:
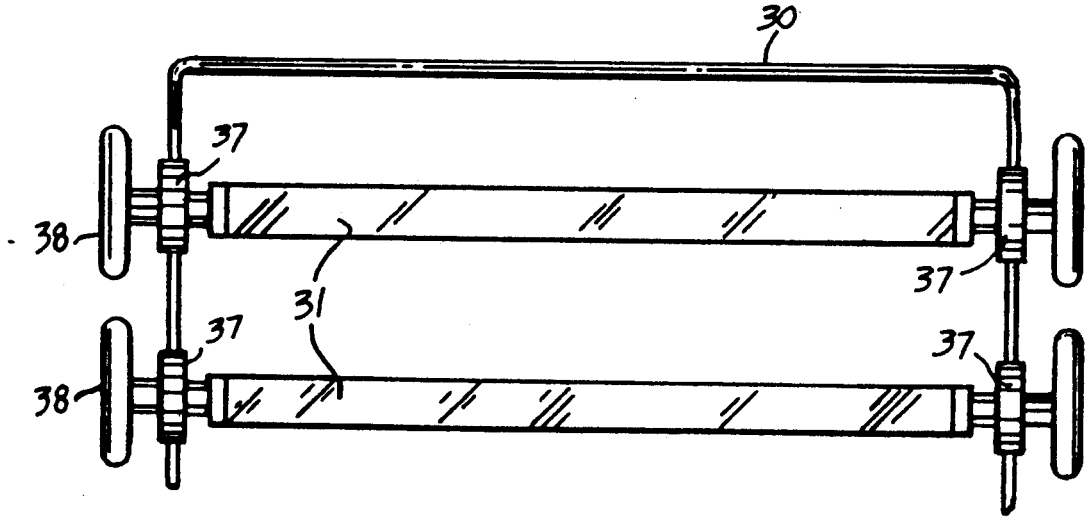
FIG. 5 is an orthographic illustration of the illumination bulbs and their mounting.

The chamber housing 9 includes a left and right support arch 25 and 26, each including a respective track, as exemplified by track **25*a* as illustrated in FIG. 4. The track 25*a* mounts a series of support wheels 38 mounted to bulb sockets 37, wherein pairs of bulb sockets are longitudinally aligned to premit opposed aligned pairs of support wheels 38 to rotatably be mounted within opposed tracks within each of the support arches 25 and 26. The left support arch 25 is illustrated to include a transparent extensible and contractable cover housing 27 of flexible construction to overlie the chamber housing 9 to permit visual observation of an infant within the associated chamber. Respective left and right transparent end walls 28 and 29 are fixedly contained within each respective left and right support arch to provide visual observation about an infant contained therewithin. A handle 30 mounted to a forwardmost end of the cover housing 27 permits reciprocation of the cover housing and associated elongate light therapy bulbs 31 mounted within opposed pairs of bulb sockets 37**.

Figure 6:
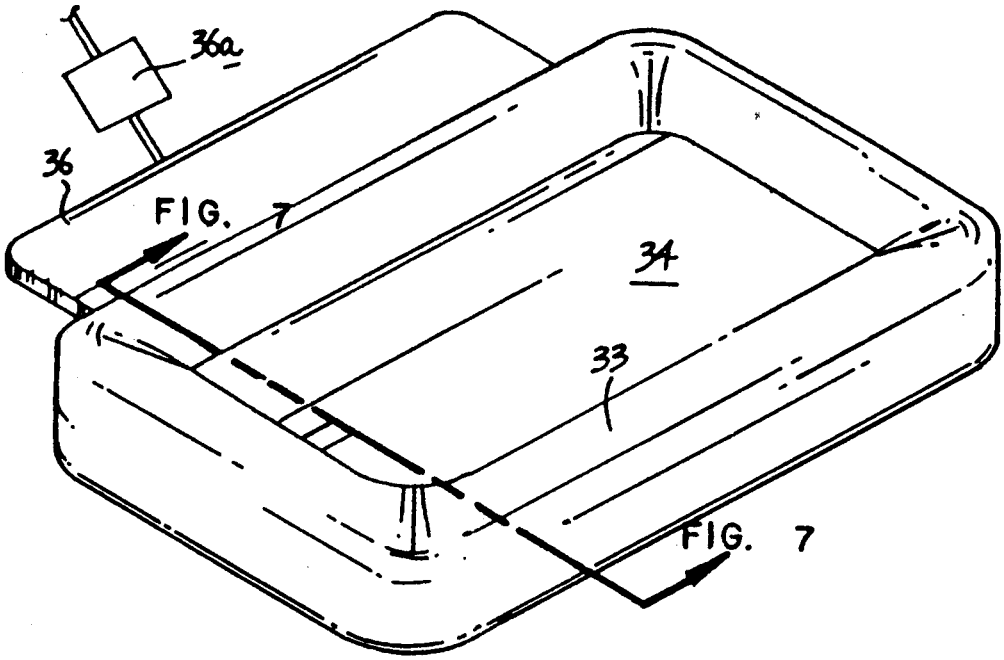
FIG. 6 is an isometric illustration of the thermal massage support cushion utilized by the instant invention.
Figure 7:
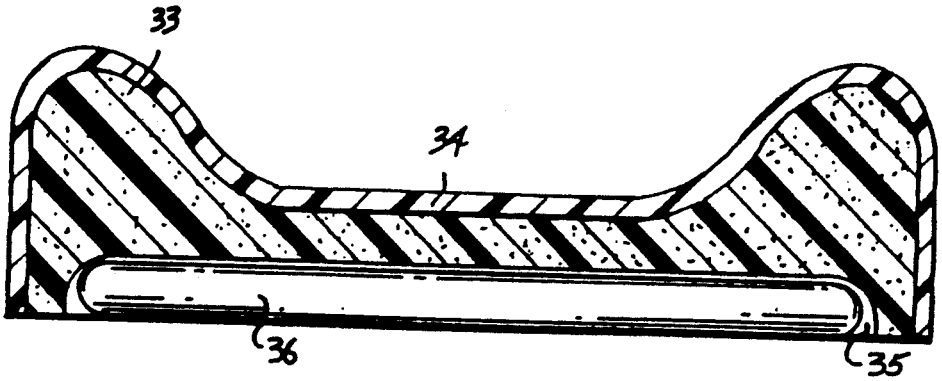
FIG. 7 is an orthographic view, taken along the lines 7—7 of FIG. 6 in the direction indicated by the arrows.

FIGS. 6 and 7 illustrate the thermal massage support cushion utilized by the instant invention, including a surrounding cushion perimeter 33, with a central cushion planar support 34 that includes a polymeric covering layer thereover. A bottom cavity 35 is formed through a bottom surface of the central planar support 34 to removably receive a massage and thermal unit 36 of a complementary configuration to that defined by the cavity 35 that cooperates with a heat and massage control means **36*a*** to effect selective heating and massage of an infant contained within the support cushion.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A newborn infant therapy apparatus comprising, a support cabinet housing, including a front vertical wall, the front vertical wall including a cardio-respirator monitor device, and a pulse-oximeter mounted through the front wall, and a first and second shelf mounted within the housing, and an oxygen tank mounted the front wall adjacent the pulse oximeter, and a plurality of aligned supply draws mounted to the front wall, and the housing including a planar left support shelf, the planar left support shelf including an intravenous support post and hook fixedly and orthogonally mounted to the left support shelf, and a right support shelf coplanar with the left support shelf extending longitudinally of and beyond the housing and fixed thereto, and a support chamber floor mounted between the left and right support shelves coplanar therewith, including a chamber housing overlying the chamber floor, wherein the chamber housing includes a left and right support arch fixedly mounted orthogonally overlying the support chamber floor, with the left and right support arch arranged parallel relative to one another, and each arch including a support track coextensive with the arch and formed to a bottom surface thereof, and an aligned parallel series of elongate therapy bulb members, each bulb member longitudinally aligned relative to the chamber housing and each bulb including a bulb socket mounted at each end of each respective bulb to define a bulb socket pair, each bulb socket pair rotatably mounting a support wheel, with each support wheel rotatably mounted within a respective track of each respective left and right support arch.

2. An apparatus as set forth in claim 1 including a transparent extensible and contractable flexible cover overlying the bulbs.

3. An apparatus as set forth in claim 2 with each respective left and right support arch including a transparent end wall.

4. An apparatus as set forth in claim 3 including a thermal massage support cushion, the thermal massage support cushion positioned within the chamber housing, and the thermal side support cushion including a surrounding cushion perimeter overlying a central planar cushion support.

5. An apparatus as set forth in claim 4 wherein the support cushion further includes a polymeric cover layer overlying the cushion perimeter and the cushion support.

6. An apparatus as set forth in claim 5 wherein the central cushion support includes a bottom cavity, and a thermal massage unit defined by an external configuration complementary to that of the bottom cavity.

7. An apparatus as set forth in claim 6 including control means to effect heat and massage control of the massage unit.

* * * * *